United States Patent [19]

Osofsky

[11] Patent Number: 4,664,035

[45] Date of Patent: May 12, 1987

[54] MISSILE WARHEADS

[75] Inventor: Irving B. Osofsky, Rancho Palos Verdes, Calif.

[73] Assignee: Science Applications International Corp., La Jolla, Calif.

[21] Appl. No.: 353,174

[22] Filed: Mar. 1, 1982

[51] Int. Cl.[4] ..... F42B 13/18; F42B 13/48

[52] U.S. Cl. ..... 102/493

[58] Field of Search ..... 102/389, 491, 493

[56] References Cited

U.S. PATENT DOCUMENTS

| | | | |
|---|---|---|---|
| 2,007,026 | 7/1935 | Robertson | 102/493 |
| 2,411,862 | 12/1946 | Arnold | 102/493 |
| 3,021,784 | 2/1962 | Meddick | 102/493 |
| 3,757,693 | 9/1973 | Shea | 102/493 |
| 3,820,464 | 6/1974 | Dixon | 102/493 |
| 3,853,059 | 12/1974 | Moe | 102/493 |
| 4,068,590 | 1/1978 | Pearson | 102/493 |
| 4,312,274 | 1/1982 | Zernow | 102/493 |

*Primary Examiner*—Deborah L. Kyle
*Assistant Examiner*—Ted L. Parr
*Attorney, Agent, or Firm*—Bruno J. Verbeck

[57] ABSTRACT

An improved anti-ballistic missile warhead in which the missile structure and warhead projectiles are combined into a single entity. The structure, which may be formed of superalloy to resist heat, requires no heat shield, the outer surface being aerodynamically smooth. It is fabricated by precision casting, individual projectiles being pre-formed by casting internal cavities which delineate the projectiles for at least a substantial part of the thickness of the casting. Figuratively, the combined missile structure and warhead is in the form of a pineapple or hand grenade which is "inside out". The explosive may be cast in place or installed separately within a thin canister. Because there is no skin to pierce, less explosive is required and dispersion is substantially reduced.

18 Claims, 21 Drawing Figures

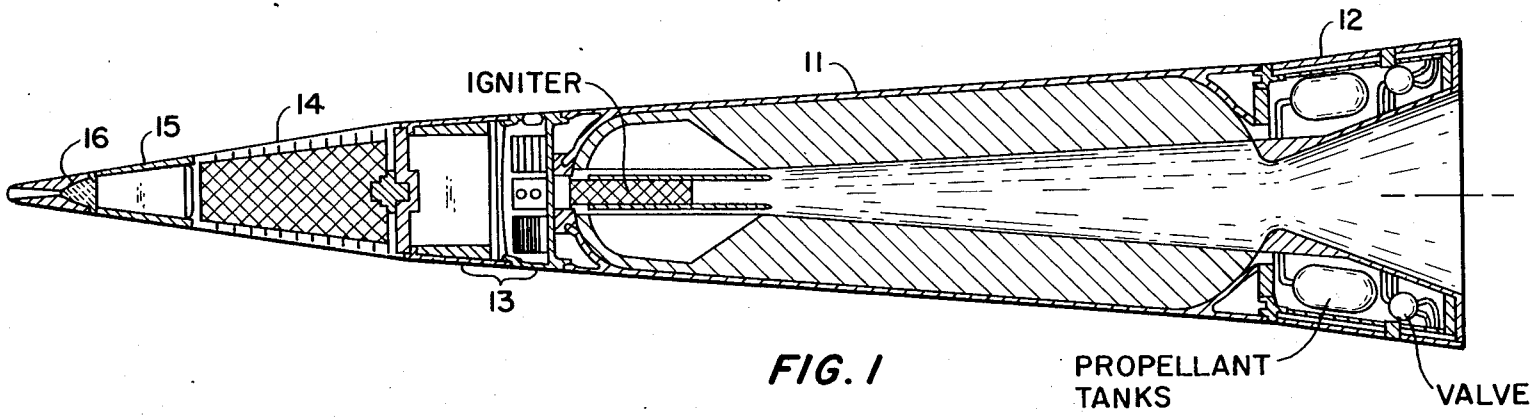
FIG. 1
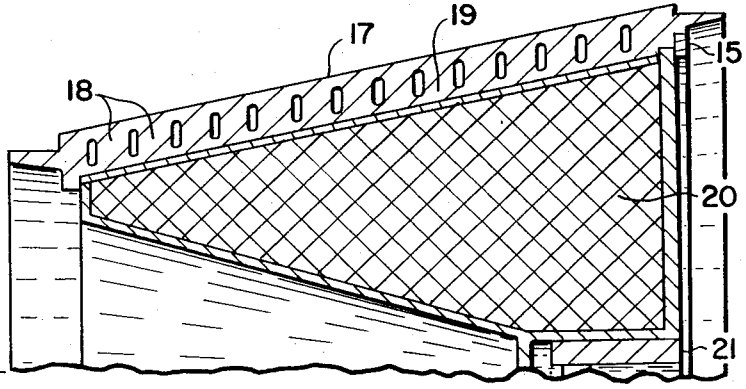
FIG. 2
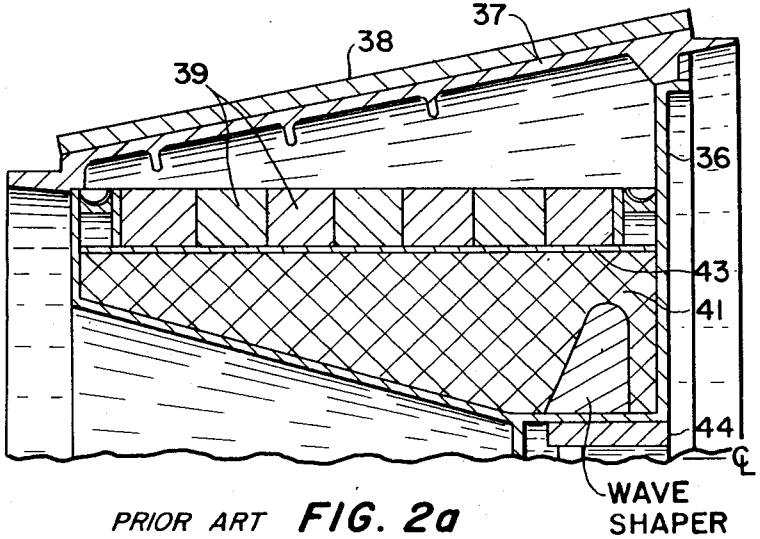
PRIOR ART FIG. 2a

1. C/m = 1.4
2. TOTAL WEIGHT = 859 LB.
3. ρ = NON-WARHEAD VEHICLE VOLUMETRIC DENSITY $$\frac{\text{SKIN WEIGHT}}{\text{SKIN AREA}} = .0376 \text{ LB/IN.}^2$$

1. C/m = 1.1
2. WEIGHT OF REGION A & B = 60.9 LB. ASSUMES BALLAST WEIGHT IS ZERO

MISSILE WARHEADS

BACKGROUND OF THE INVENTION

Conventional warheads of anti-ballistic missiles, especially of the larger size, comprise separate munitions which are positioned in a canister of plastic, composite, aluminum or steel, which is itself contained within the missile skin and structure. These warheads are usually cylindrical in shape and have pre-formed projectiles surrounding a cylinder of explosive. The missile structures themselves are highly specialized, with a heat shield secured to the outer surface thereof. Normally, the warhead is designed as an independent package to be inserted into a missile structure as a component thereof. Pre-formed projectiles, usually in the form of cubes, are placed over the explosive charge and held in place by an exterior layer of fiberglass, plastic, composite, or metal. The entire warhead unit is fitted with a flange and a forward support so that it can be bolted into the missile structure. The warhead structural elements must be rigid and strong to withstand the missile acceleration loads without greatly deflecting or fracturing the explosive or displacing the projectile pattern. These loads are generally supported at the forward and aft flanges where the warhead assembly interfaces with the missile structure. It is usual practice to avoid rings or frames and discontinuities on the missile structure which must be pierced by the warhead fragments.

The missile structure actually duplicates, to a degree, the function of the warhead structure, and also provides stiffness to the sections of the missile forward and aft of the warhead. The warhead is usually emplaced as far forward as possible in the missile because the warhead is the single heaviest and densest component of the missile assembly and, its forward location reduces the amount of ballast that is required for stability and balance. Special effort is always made to position the warhead as close as possible to the outer skin line so as to more fully utilize the internal volume of the missile.

When the warhead is detonated, the projectile pattern must penetrate the missile structure and the missile heat shield to reach the target. This tends to scatter the projectiles, and the precise pattern is perturbed as projectiles are deflected by bits and pieces of structure. In addition, some energy is lost in the penetration and acceleration of the structure by the projectiles and explosive. Because there are really three layers of structure to be accelerated by the explosive, and two to be penetrated by the projectiles, the pattern disturbance and loss of effective charge-to-mass ratio. becomes significant. Furthermore, it is possible for projectile breakup to occur as a result of the skin penetration process, particularly for projectiles with a significant L/D (length to diameter ratio).

Missile and warhead designers have attempted to minimize the losses and disturbances by various techniques including making the warhead casing an integral part of the missile skin and structure. While such procedure eliminates weight, simplifies assembly, and allows the maximum effectiveness within the overall missile diameter constraint for tactical missiles, the requirement for heat shielding limits the general applicability of such an approach, where strategic interceptor missiles are concerned.

Warheads of the prior art have involved the use of a cylindrical projectile casing over a cylindrical explosive container. This necessarily does not utilize maximum volume available and results in an unfavorable aft center of gravity location. The warhead of the present invention is shorter for the same weight, and fits further forward because of its conical shape. This reduces the length of the missile as well as the ballast weight. Furthermore, for the same size, the missile structure weight is eliminated, and with no skin to pierce, less explosive is required and dispersion is eliminated. As a result the cost is reduced for the structure and for the warhead.

SUMMARY OF THE INVENTION

The present invention is directed to and comprises an improved anti-ballistic missile wherein the warhead projectiles are integrated into the missile structure.

The integrated missile structure and warhead projectiles comprising my invention are fabricated by precision casting, individual projectiles being pre-formed by casting internal cavities which delineate the projectiles for much of the thickness of the casting. The integrated missile structure can be described as being, in appearance, similar to a pineapple or hand grenade which is "inside out", the score marks being on the inner surface of the structure whie the outer surface is aerodynamically smooth. In outward appearance the structure can be cylindrical, a truncated conical frustum or a truncated ogive, and the entire missile volume can be utilized, thereby improving the volumetric efficiency.

The outer portion of the structure is a continuous metal shell, preferably formed of a superalloy such as MAR-M200*, and which may be coated with a thin ceramic coating such as $Al_2O_3$ or $ZrO_2$, which outer shell is capable of carrying the weight of the projectiles which are integrally cast with the structure.

*

*MAR-M200 - A superalloy comprising the following components by weight:

| | | | | | |
|---|---|---|---|---|---|
| Nickel | 60% | Columbium | 1% | Boron | .015% |
| Chromium | 9% | Aluminum | 5% | Zirconium | 0.05% |
| Cobalt | 10% | Titanium | 2% | | |
| Tungsten | 12% | Carbon | 0.15% | | |

(High Temperature High Strength Nickel Base Alloys, published by International Nickel Co., 3rd Ed., July 1977; See page 4)

The projectiles are formed at the time of casting by properly shaped cores which are placed in the mold, the cores being designed to produce a sandwich structure in which the projectiles provide the core of the sandwich. Such cores comprised of fused silica with proprietary additions, are widely used to fabricate, e.g., hollow turbine blades and complex internal passages, and are leached from the finished casting with a solution of an alkali such as sodium hydroxide. Cores are obtainable from such sources as Industrial Ceramics Corp. of Torrance, Calif. Certech Corporation of Westwood, N.J.; Fibeco Corp. of Cleveland, Ohio; and Sherwood Ceramics Corp. of Cleveland, Ohio. In the alternative, the projectiles can be formed by properly shaping the wax pattern so that the grooves are formed without cores. A pre-packed explosive container may then be inserted flush with the inner structure; when the explosive is detonated the thin layer of metal joining the projectiles on the inside and at the "skin" line shears, and the undisturbed projectiles are directly accelerated. No skin structure or structures need be penetrated, and therefore all of the mass over the explosive is usable mass, and the effective charge/mass ratio is maximized. Furthermore, accuracy of the pattern is enhanced because there is no missile structure to deflect the projectiles.

* In the coreless construction there is no inner skin to shear. Only the metal joining the preformed fragments at the skin line shears.

The effective weight of the explosive warhead is reduced because there is no wasted missile structure. Thus, for one typical warhead, the actual weight could be increased in excess of twenty pounds in an integrated design due to the heat shield/structural weight savings. A further advantage is that the effective velocity of the projectiles will be higher for the same weight of explosive and the projectile pattern will be undisturbed. Furthermore, the warhead will have a more forward center of gravity because, its available outer diameter being effectively larger, it can be moved forward. This decreases and may even eliminate ballast weight, while further increasing the relative efficiency of the integrated warhead.

Other features and advantages of the invention will become apparent from the following description of the preferred embodiments, together with the accompanying drawings.

BRIEF DESCRIPTION OF THE DRAWINGS

FIG. 1 is a schematic representation of an interceptor missile containing the integrated warhead of the present invention;

FIG. 2 is a schematic representation in cross-section of the sandwich type integrated warhead;

FIG. 2*a* is a schematic representation in cross-section of a warhead structure of the prior art;

Figure 8:
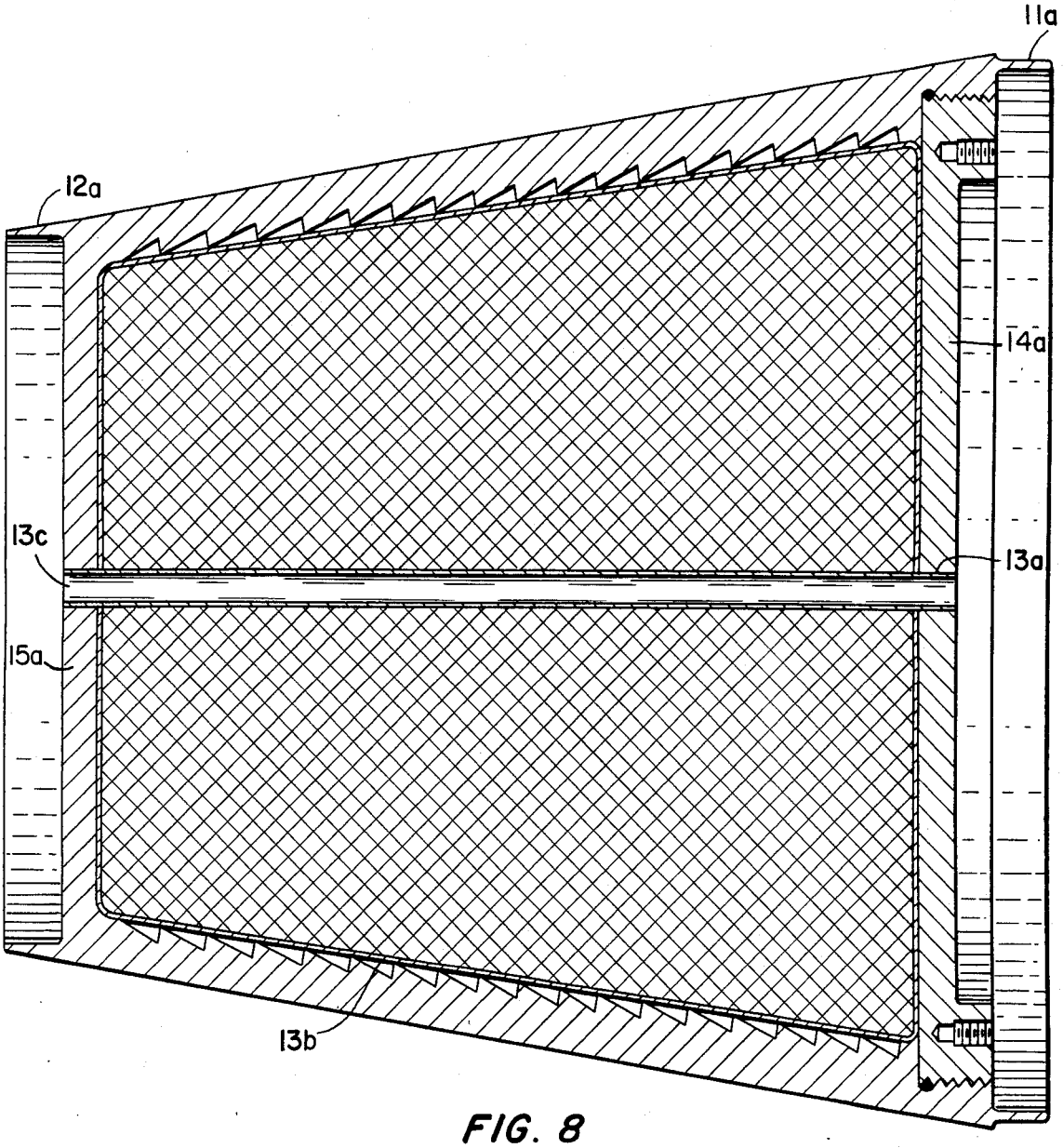
Figure 9:
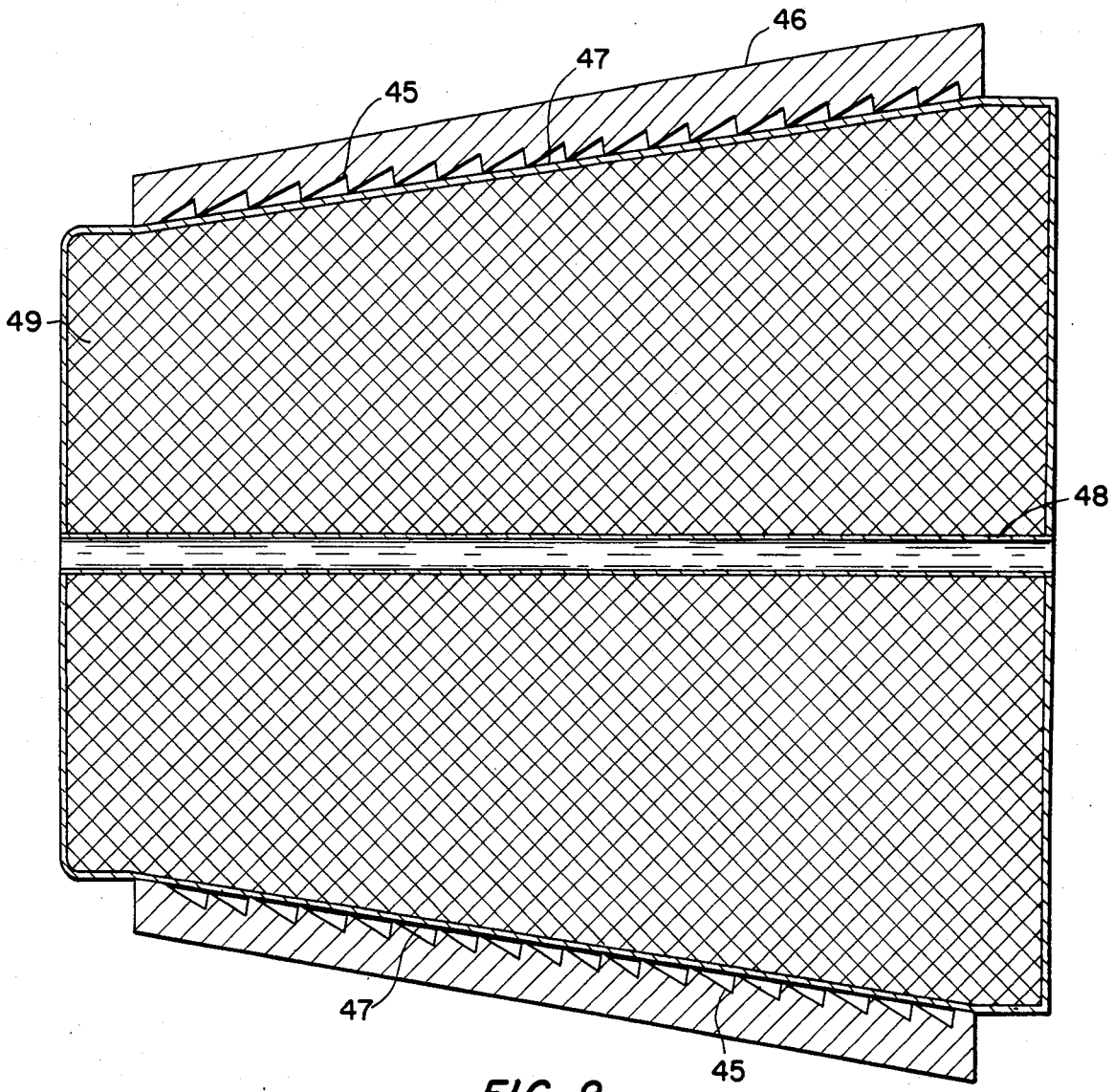
Figure 10A:
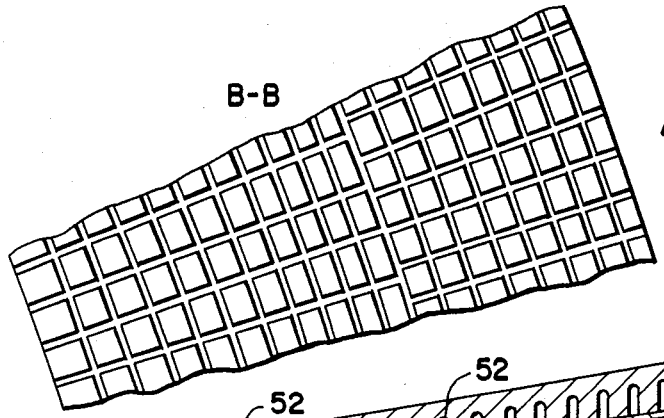
Figure 10:
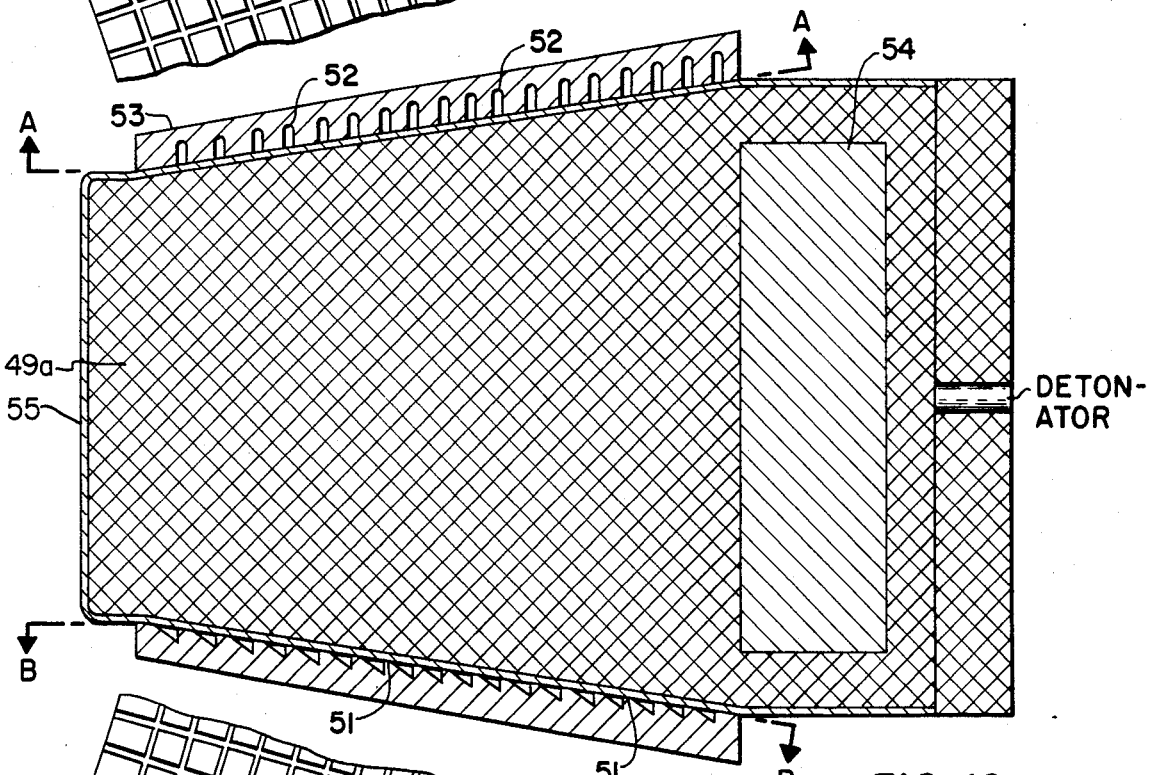
Figure 11:
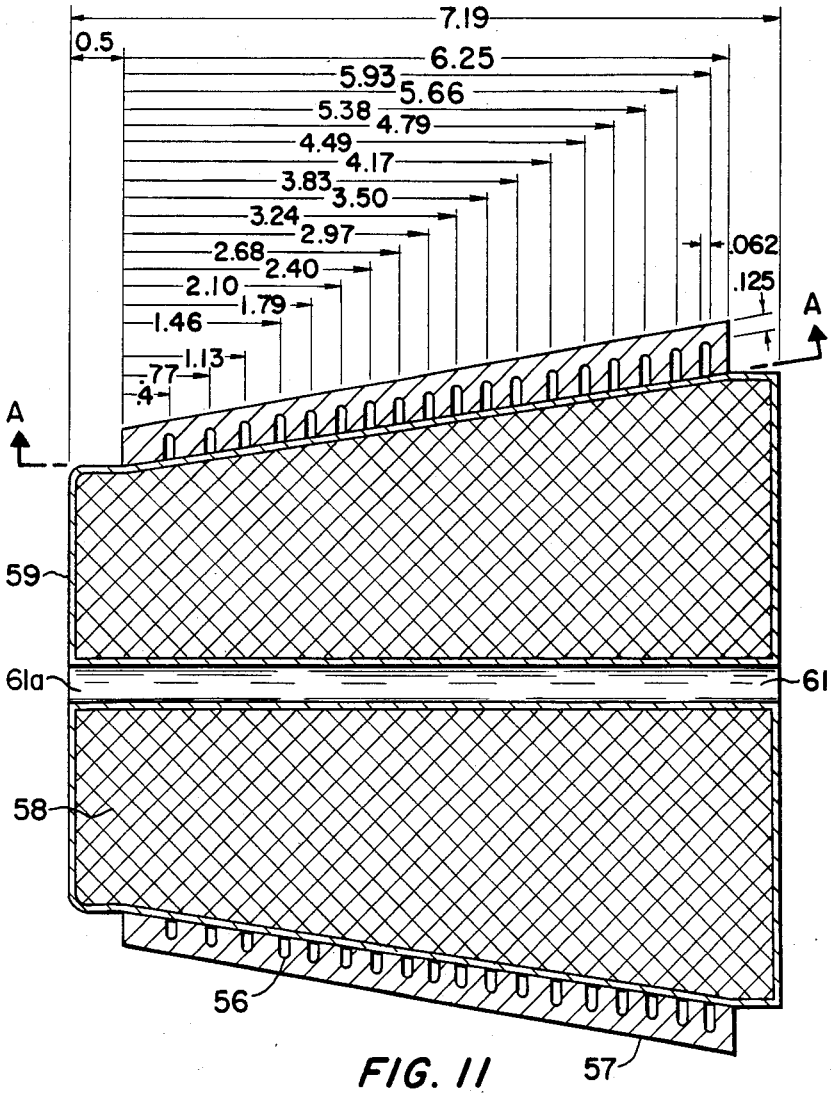
Figure 12:
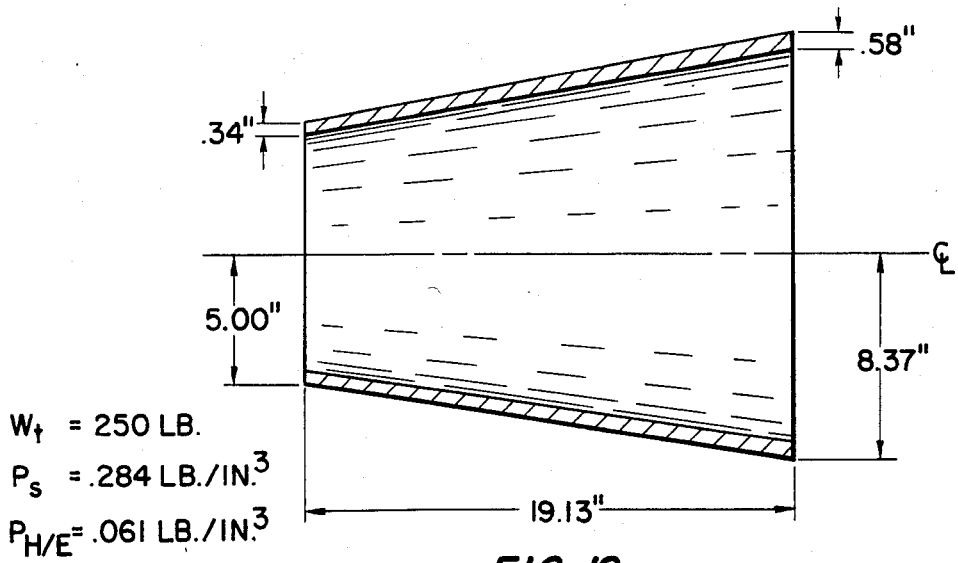
Figure 13:
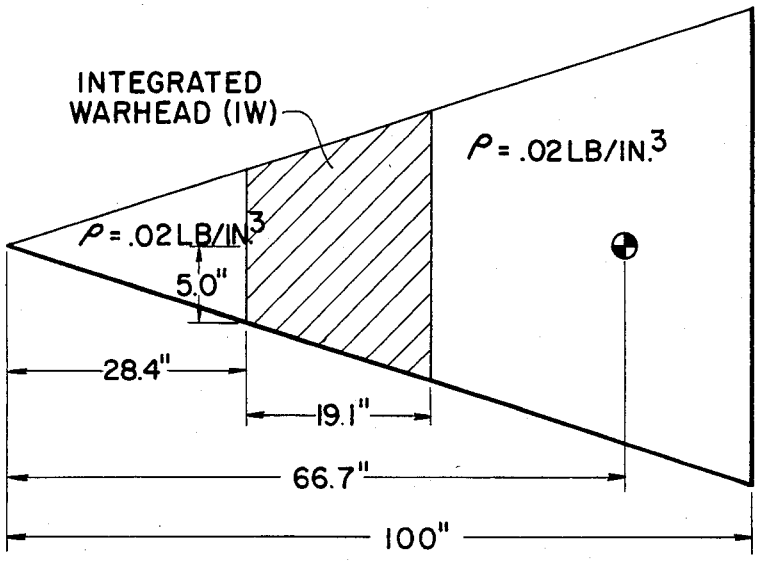
Figure 14:
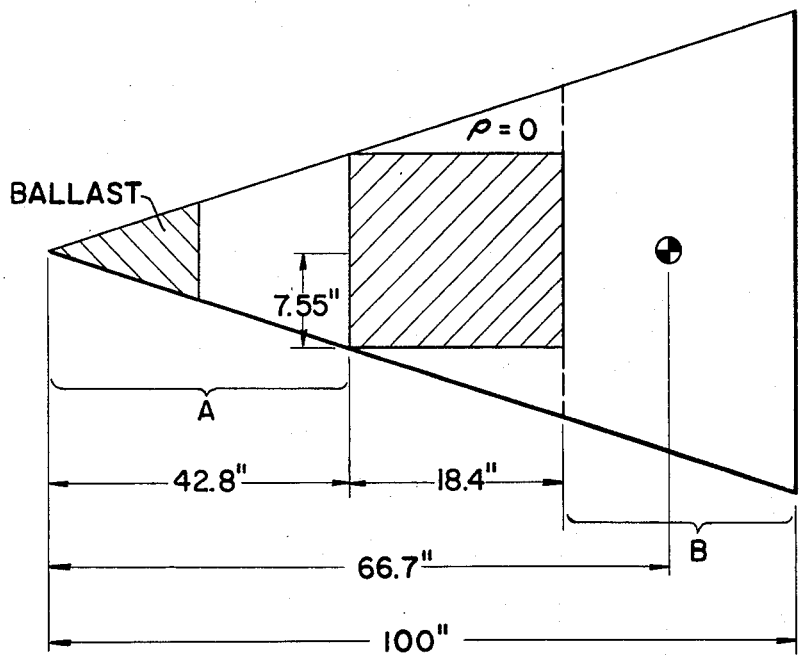
Figure 15:
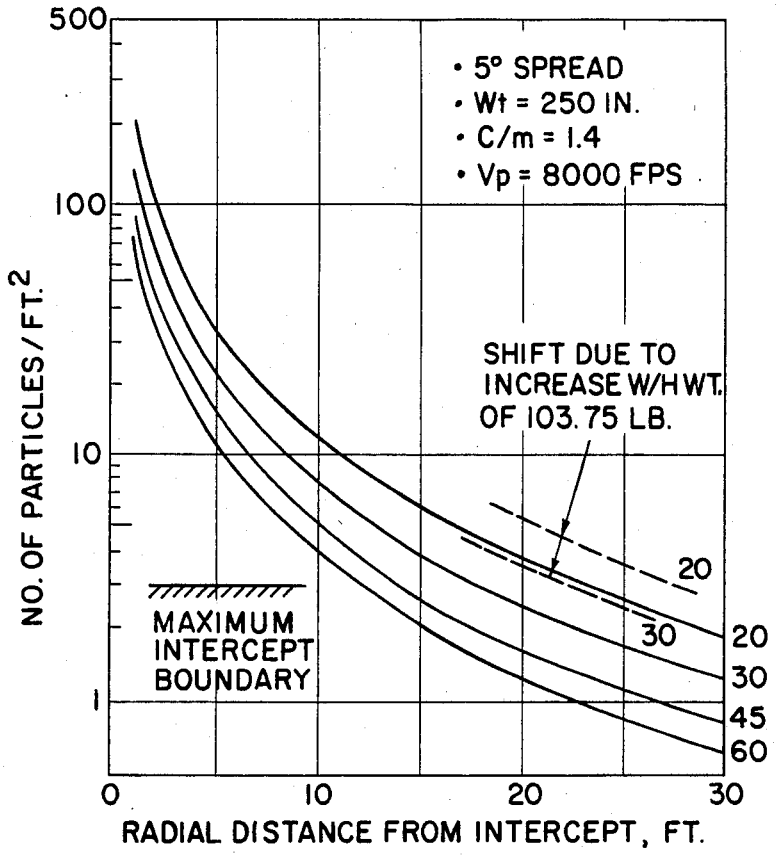

FIG. *7a, 7b, 7c* and *7d* illustrate schematically the type of projectile that can be formed from the integrated warhead concept of shaping the ceramic cores as desired;

FIG. 8 shows in further detail the integral warhead with the structure generally in the shape of a conical frustum, the structure forming the outer casing of the warhead, and the missile skin internally scored;

FIGS. 9, 10, and 11, show other optional designs of the integral warhead;

FIG. 12 show somewhat schematically one embodiment of a integral warhead, with illustrative dimensions;

FIG. 13 is another schematic view of the integrated warhead missile, with illustrative dimensions;

FIG. 14 is a schematic representation of a conventional warhead structure, with illustrative dimensions;

FIG. 15 shows the beneficiality of the lesser weight of the integral warhead structure versus the weight of the conventional warhead structure.

DETAILED DESCRIPTION OF PREFERRED EMBODIMENT

Referring to FIG. 1, an interceptor missile is shown, somewhat schematically, comprising a rocket motor 11, aerodynamic control system 12, electronics, battery, and guidance control systems shown generally at 13, an integrated warhead 14, a seeker 15, and fuze 16.

As shown schematically in FIG. 2, an integral warhead, comprises an outer portion which is continuous metal sheet 17 capable of carrying the weight of a multiplicity of projectiles 18 which are integrally cast with the structure. In this example there is also a continuous load carrying inner metal sheet 19 which acts in conjunction with the outer sheet 17, and the integral projectile 18, to form a concentric sandwich beam with an extremely high stiffness and moment of interia; this results in increased resistance to deflection from local aerodynamic forces, blast loads and missile maneuvers.

The explosive charge 20 is contained directly within the integral warhead inner surface 19, by a thin metal, composite or plastic canister 14 retained by adhesive, or mechanically by bolts and/or a ring 15. The safe and arm device, and detonator are shown at 21.

Figure 3:
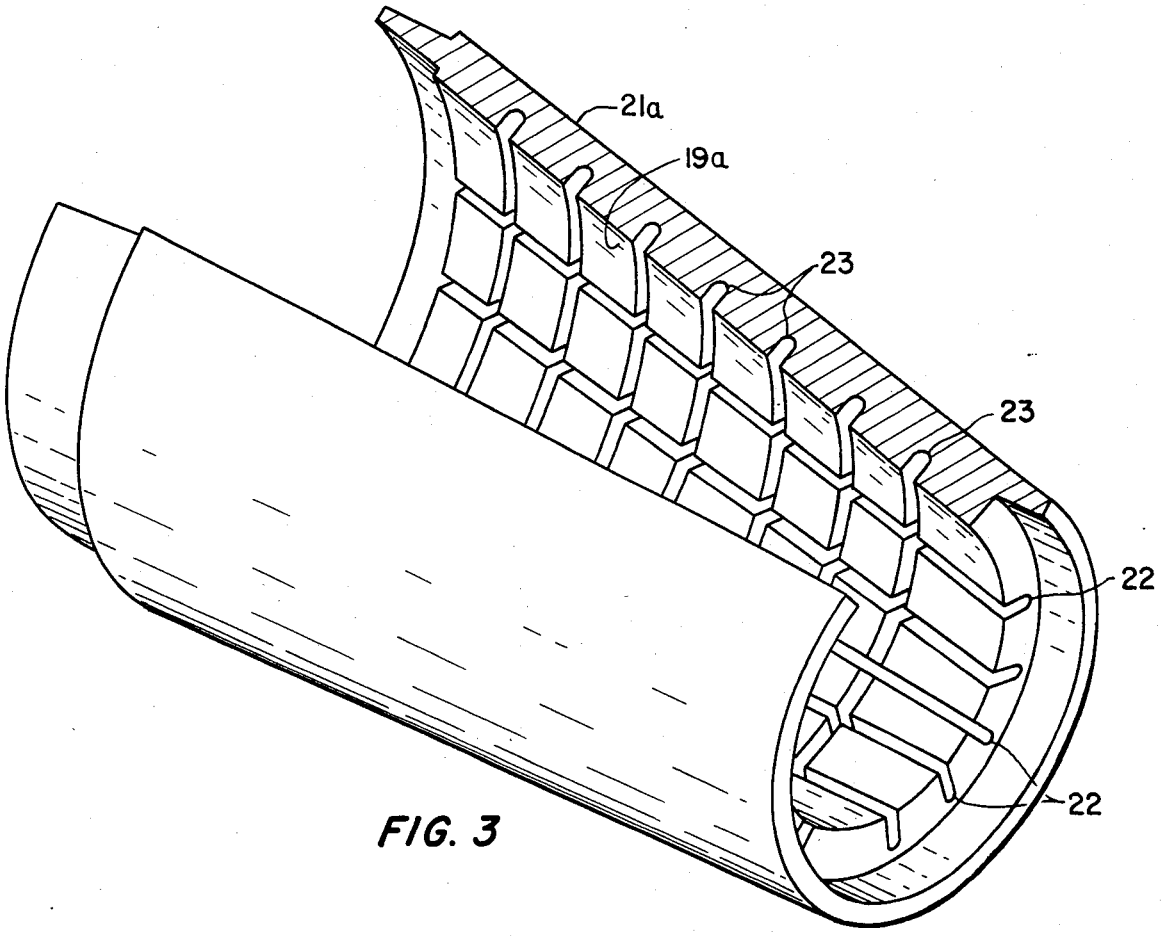
FIG. 3 illustrates in perspective the integrated warhead showing a continuous waffle grid with a convolute pattern that forms cubes held together by the outer skin.
Figure 4:
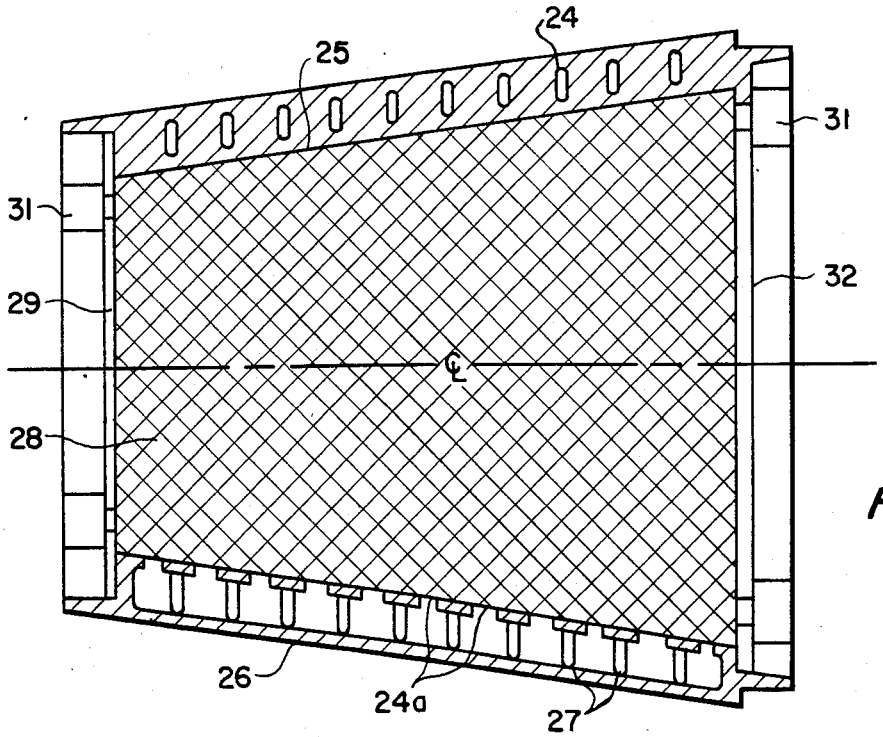
FIG. 4 illustrates a variation of the integral warhead in which the ceramic core that forms the projectile chunks does not extend completely through the inner surface except in local spots.

A conventional warhead, shown schematically in cross-section in FIG. 2*a*, comprises a warhead mount 36, missile structure 37 of metal or composite, a heat shield 38 of suitable heat resistant material, pre-shaped fragments 39, and an explosive charge 41 contained in canister 43. The safe and arm device and detonator are shown at 44. Compared with a typical conventional warhead installed as shown above, my novel integrated warhead in a conical missile can contain incrementally more than 40 pounds of explosive and projectile material for the same combined weight of warhead and missile material, as a result of the heat shield/structural weight savings. Furthermore, with my improved warhead construction, the effective velocity of the projectiles is approximately 15% higher for the same weight of explosive, and the projectile pattern is undisturbed and precise. Also, my warhead will have a more forward center of gravity because its available outer diameter is effectively larger, and it can therefore be positioned more forward. Also it has 100% volumetric efficiency so it is shorter than a cylinder. This results in a decrease in ballast weight, and further increases the relative efficiency of the warhead, Illustrated in FIG. 3, is a continuous waffle grid warhead with a convolute pattern that forms cubes 19*a* held together by the outer skin 21*a*. Axial grooves 22 extend through the inner wall as shown. And also as shown, circumferential grooves 23 extend through the inner walls, too. A variation in warhead structure, also comprising my invention, is shown in FIG. 4, in which the ceramic core 24 that forms the projectile chunks does not extend completely through the inner shell 25 except in local spots 24*a* as shown. This produces an extremely stiff sandwich type of construction at no increase in weight. Also shown in FIG. 4 is the outer skin 26, the circumferential core 27, the explosive 28, front cap 29, detonators 31, and rear cap 32.

Figure 5:
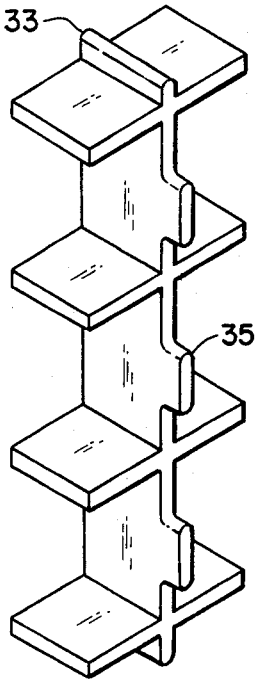
FIG. 5 is a core segment which is cemented together to form the complete core of FIG. 6.
Figure 6:
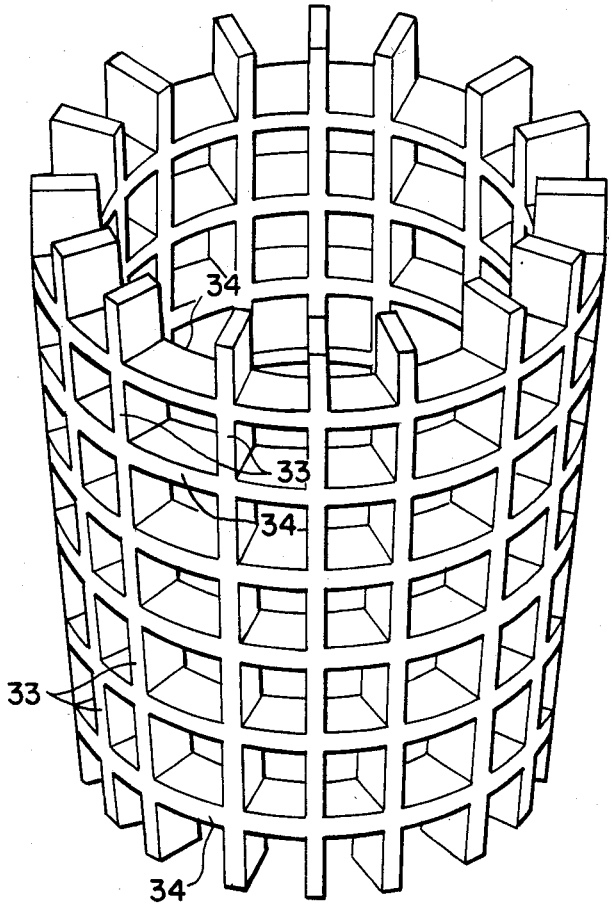
FIG. 6 shows the integrated warhead ceramic core assembly for a sandwich type of construction.
Figure 7A:
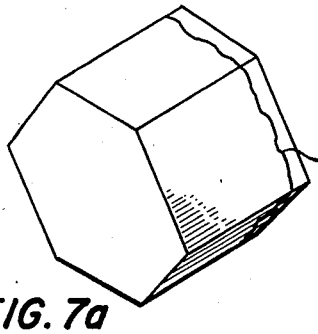
Figure 7B:
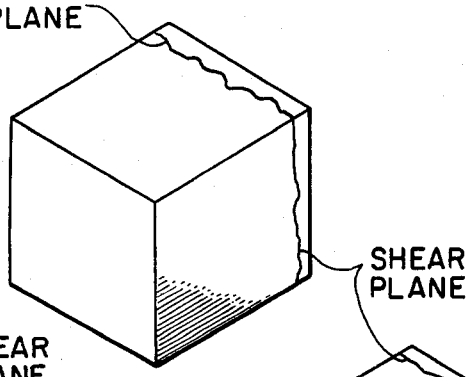
Figure 7D:
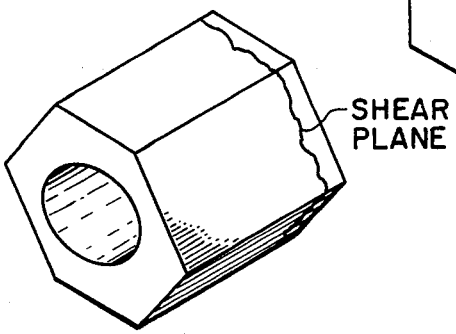
Figure 7C:
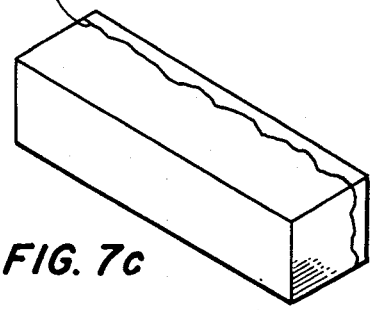

The core that produces the pattern shown in FIG. 4 is illustrated in FIGS. 5 and 6. The ceramic waffle core segment shown in FIG. 5 comprises a continuous axial gap former 33, a circumferential gap former 34, and inner wall anchor 35. Alternatively, the anchors could be on the circumferential gap formers or on both. Segments, such as shown in FIG. 5 are cemented together to form the complete core assembly. As illustrated in FIG. 6, there is a further showing of the axial gap formers 33, and circumferential gap formers 34.

The type of projectile that can be formed in accordance with my concept of shaping the ceramic cores properly includes hexagons *7a*, cubes *7b*, rods *7c*, and a "cookie cutter" design *7d* which is essentially a hexagon with a partial hollow characterized to have enhanced penetration per pound of weight.

The technique of precision casting is an age-old art. A discussion of precision casting is found, e.g., on page 13-3, "Foundry Practice and Equipment", by Carl R. Loper, Jr. of *Mark's Standard Hanbook for Mechanical Engineers,* 8th Edition, edited by Baumeister et al., and published by McGraw-Hill.

In making the missile structure of my invention by the "lost wax" process, a precise mold is fabricated which is used to cast an exact replica of the desired part in wax or acrylic plastic. Allowance is made for thermal expansion and contraction in the mold. In some cases the wax duplicate may be "welded" together from a number of subassemblies.

The wax or acrylic duplicates are alternately dipped into ceramic powder and liquid for a number of times to build up a layer of ceramic of a thickness of about 3/16 in. to ¼ in., which completely covers the wax or acrylic pattern. After the ceramic dries and hardens, it is heated to melt out and vaporize the wax or plastic pattern, and vitrify the ceramic, and superalloy is poured into the hot mold in a vacuum. After the metal cools, the ceramic pattern is broken away to leave a precision metal casting.

The process is automated so that very little skilled labor is required after the initial mold is developed. The process is in wide use to manufacture waveguides, gas turbine blades and parts, golf clubs, gun parts, etc. High precision is attained at little cost. Labor cost is minimized as is machining because the proper design of a mold results in a part that requires a minimum of machining.

INTEGRAL WARHEAD STRUCTURE PERFORMANCE CHARACTERISTICS

Performance characteristics of my integral warhead structure will now be described in the context of a typical interceptor re-entry vehicle encounter.

As discussed above, the integral warhead structure of my invention is one in which the missile structure forms the outer casing of the warhead, the structure being generally in the shape of a conical frustum. At the appropriate location, the missile skin is locally designed to be at the proper thickness and is internally scored in a grid-shaped pattern so as to form regular, precisely shaped projectiles upon detonation of charge. The charge and the detonators are contained within the shell as shown in FIG. 2. FIGS. 8 through 11 illustrate other, optional designs. The integral warhead structure formed by the precision casting process and the internal scoring pattern being cast into place in the structure, no machining is required except on the outer diameter and the joints.

For the embodiment shown in FIG. 8, the flanges 11*a* and 12*a* extend forward and aft for attachment to the fore and aft portion of the missile. Sharp grooves in a grid pattern are integrally cast into the shell. The composition B military explosive is contained in a thin-walled aluminum canister 13*b* which can be loaded into the missile in the field if desired. Composition B, a mixture of 60% RDX granules in 40% TNT, is a widely-used military explosive. A tube 13*a* which is integral with the explosive canister permits insertion of a line initiator 13*c* for generation of a uniform fragment spray pattern. Metal end plates 14*a* and 15*a* on each end of the explosive charge provide reaction mass and help confine the explosive charge so as to promote projectile pattern and velocity uniformity, For the missions of interest, no thermal insulation is required over the warhead section other than an approximately 0.005 in. thickness of $Al_2O_3$ to reflect thermal radiation from a nearby nuclear blast.

If charge end confinement is attained by extra explosive rather than by metal, then the integrated warhead structure would have the appearance shown in FIG. 9, wherein sharp grooves 45 in a grid pattern are integrally cast into the shell 46. The explosive is contained in aluminum canister 47, and a tube 48 permits insertion of a line initiator therein. The charge 49 projects from each end as shown and acts to maintain constant pressure against the projectile during detonation.

Figure 10B:
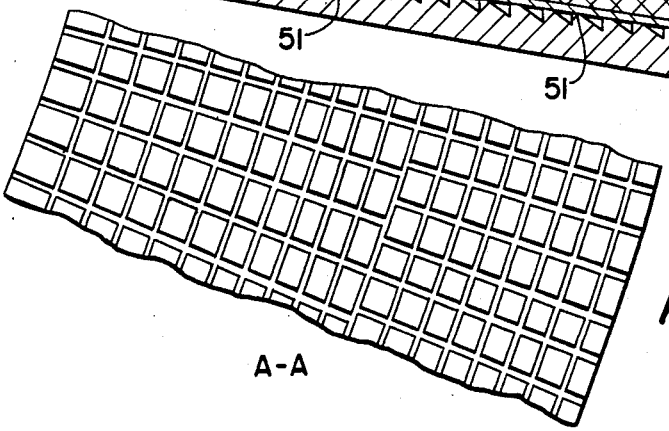

FIG. 10 illustrates the use of a wave shaper 54*a* to obtain a more uniform end initiation of the charge. As in the embodiment shown in FIG. 9, grooves are integrally cast into the shell 53, with explosive 49 contained in canister 55. It will be noted that there are two types of grooving, a sawtooth 51 and annular 52. These are alternative designs and are not intended to be on a single warhead. It is also to be noted that the gridwork pattern changes, as shown in FIGS. 10*a* and 10*b* so as to allow for constant charge/mass (c/m) ratio and to optimize the shape of the projectiles. Line initiation may also be used to achieve detonation and fragmentation as seen in FIG. 11, which shows more details of the annular groove design, including illustrative progressive changes in spacing between grooves to effect constant charge/mass (c/m) ratio, and optimization of projectile shapes. Grooves 56 are integrally cast into shell 57. Explosive 58 is confined within canister 59 and a line initiator 61*a* may be inserted in tube 61. The outer ends of the annular grooves 56 can be round but are preferably sharp and of sawtooth configuration to provide uniform projectile breakup. Although not illustrated herein, there are similar grooves running fore and aft to form a grid.

INTEGRAL WARHEAD PERFORMANCE CHARACTERISTICS

In studies of the invention the particular parameters or characteristics investigated included: projectile impact energy and projectile aerial density. These parameters are influenced by charge to mass ratio, interceptor and RV velocities, crossing angle between interceptor and RV, projectile size and warhead detonation point relative to interceptor and RV location. It is to be understood that specific scenarios and mission requirements would be used in design optimization studies.

Design Parameter Variation

To the end of evaluating the performance characteristics of the integrated warhead structure of my invention, a base line interceptor vehicle design was formulated. The nominal interceptor warhead design consisted of a warhead placed within a blunted sphere cone with a 10° half angle. The leading edge station of the integrated warhead was at a position where the cone radius was 5 inches. For projectile velocities of 8,500 feet per second, the nominal charge to mass ratio is 1.4. An overall warhead weight of 250 pounds leads to the embodiment shown schematically in FIG. 12, this being a schematic cross-sectional view of such an integral warhead structure showing constant charge to mass ratio design. The constant charge/mass ratio is attained by tapering the outer casing. A charge to mass ratio of 0.62 was also investigated for which the projectile velocity would be 6,000 feet per second.

COMPARISON OF A MISSILE STRUCTURE CONTAINING A SELECTIVELY AIMED WARHEAD WITH A MISSILE STRUCTURE HAVING AN INTEGRATED WARHEAD

An analysis was performed to compare a missile structure containing a selectively aimed warhead and a missile structure with the integrated warhead of the present invention to illustrate the weight advantages of the integrated warhead structure.

The following assumptions were imposed in this analysis:

(1) Missile shape was a 10° half angle cone with a length of 100 inches.

(2) The center of gravity was located at 66.7 inches aft of the nose.

(3) Weight of guidance, fuzing, control hardware, etc. was assumed to be the same for both missiles.

(4) Warhead -

(a) Integrated warhead had a leading edge station diameter of 10" and a c/m= .4;

(b) Selectively aimed warhead had a c/m=1.1, a length of 18.4" and a diameter of 15.1";

(c) Warhead weighs 250 lbs. for both cases.

The charge to mass ratio was determined from the requirement that the initial projectile velocities be 8000 fps. For the integrated warhead this required a charge to mass ratio of 1.4. For the selectively aimed warhead, enhancement of the velocity is assumed due to the detonation geometry. Consequently, a smaller c/m ratio is needed than 1.4 to accelerate the "directed" particles to 8000 fps.

The overall weight of the integrated warhead missile and structure was calculated to be 859 lbs. by assuming the volumetric density of the missile and structure was a constant for all regions outside the warhead. This density value was 0.02 lb/in$^3$ (see FIG. 13). To be determined is the amount of ballast needed to have the selectively aimed warhead missile structure have a c.g. also at 66.7".

The selectively aimed warhead missile schematic shown, in FIG. 14 illustrates the components of the analysis. Because the selectively aimed warhead is larger in diameter than the integrated warhead, it has to be placed farther aft than the equivalent location of the integrated warhead. Therefore ballast is needed to ensure that the c.g. of missile is kept at 66.7% of vehicle length. As stated above, the volumetric nonwarhead weight density is such that the nonwarhead weight of this vehicle is the same for both missiles excluding ballast. At the radial locations outside of the warhead there is nothing except the outer skin which has a weight per unit surface of 0.0376$^2$ lb/in. This value was determined from typical interceptor structure weight values listed in the literature. In summary, it is seen that the weight of the missile ahead of and aft of the warhead section must weigh 609 lbs excluding ballast. This translates into a volumetric density of 0.022 lb/in$^3$. The ballast was assumed to be tungsten with a density of 0.65 lb/in$^3$. The amount of ballast length and hence weight was determined from the following formulas:

$$\bar{x} = \frac{\Sigma w\bar{x}}{\Sigma w}$$

If no ballast is assumed, calculation for the left hand side of the above expression is 70.62", meaning that enough weight (ballast) has to be added to the nose section to move the c.g. forward. Solving for an equality, it is seen that a ballast of 63.25 lbs. is needed to cause the selectively aimed warhead missile to have a c.g. at 66.7 in.

Because of the ballast weight and outer skin weight of 40.5 lbs. surrounding the warhead, the selectively aimed warhead missile weighs 103.75 lbs. more than the equivalent integrated warhead missile structure.

To determine if the weight difference is rea11y beneficial, assume that the warhead weight of the integrated warhead missile is increased by 103.75 lbs. This translates into 42.9 lbs. of projectile weight being dispersed outward, and at large radial distances away from the vehicle. This essentially means that the projectile aerial density curves shift upward by 41.25%, as shown from FIG. 15, thereby giving one an increase in maximum radial intercept distance of about 25% for a 30 g. projectile and 22% for a 20 g. projectile. Stated another way, the integrated warhead missile has its effectiveness increased by 41% because of the weight saving capability.

ADVANTAGE OF THE INTEGRATED WARHEAD STRUCTURE

Incorporating an integrated warhead structure, in accordance with the present invention, in a typical interceptor will result in several advantages over a conventional warhead design, as follows:

(1) For a given warhead weight, the total missile weight will be reduced because the warhead replaces part of the missile structure.

(2) The missile center of gravity can be moved forward because the conical shape of the warhead structure allows packaging of the warhead farther forward in the missile structure. This also has the added benefit of reducing the ballast requirements.

(3) Aim, integrity and velocity of the projectiles are not hindered bacause the projectiles do not have to penetrate the missile wall as they do in prior art structures.

(4) Missile cost as a result of the applicant's warhead construction is reduced because of the integral casting techniques. Furthermore, the projectile cost is reduced, because individual projectiles do not have to be made and assembled as in conventional warhead designs; furthermore, no separate warhead structure and heat shield are required.

While a number of preferred embodiments of the invention have been described herein, it will be understood that various changes, rearrangements, and modifications , may be made therein without departing from the scope of the invention as defined in the appended claims.

What is claimed is:

1. A missile warhead comprising a precision cast, frangible, heat resistant superalloy shell having an aerodynamically smooth outer side, and an inner side, and having between said inner and outer sides, integrated individual projectiles which have been preformed by casting internal cavities in said shell, said cavitites delineating said projectiles for at least a substantial part of the thickness of said shell, said projectiles being shearable from each other, and from attachment to said outer and inner sides, when subjected to predetermined explosive force originating within the shell, and a detonatable explosive positioned within said shell, and adjacent said inner side for providing said predetermined explosive force.

2. A missile warhead comprising a precision cast, frangible, heat-resistant superalloy shell having an aerodynamically smooth outer side, and an inner side having a multiplicity of intersecting grooves producing indented and non-indented portions in a gridwork pattern formed during said precision casting, said indented and non-indented portions of the shell delineating the shape of individual projectiles for at least a substantial part of the thickness of said shell, and which are disconnected from each other on detonation and the consequent fragmentation of the shell; an load-carrying metal liner secured to said non-indented portions whereby to form a concentric sandwich beam for imparting improved resistance to deflection from local aerodynamic forces, blast loads and missile maneuvers, and a detonatable explosive adjacent said liner.

3. The missile warhead of claim 1 wherein the inner side of said shell has a convolute pattern forming segments of predetermined size and shape and held together by the outer side of said shell.

4. The missile warhead of claim 1 wherein said cavities are spaced apart according to a predetermined variation for allowing constant charge/mass (c/m) ratio and to optimize the shape of said projectiles.

5. The missile warhead of claim 2 wherein the said gridwork pattern contains predetermined variations in spacing therein for allowing constant charge/mass (c/m) ratio and to optimize the shape of said projectiles.

6. The missile warhead of claim 5 wherein the said variations include variations in the distance between adjoining grooves comprising said grid work pattern.

7. The missile warhead of claim 5 wherein said variations include variations in the depth of said grooves.

8. The missile warhead of claim 1 or 2 wherein said explosive positioned within said shell is in a prepacked canister.

9. The missile warhead of claim 1 or 2 wherein the said metal shell is in the shape of a truncated conical frustum.

10. The missile warhead of claim 1 or 2 wherein the said metal shell is in the shape of a truncated ogive.

11. The missile warhead of claim 1 or 2 wherein said canister includes a line initiator positioned within said canister for effecting generation of a uniform spray pattern of projectiles on detonation of the explosive.

12. The missile warhead of claim 1 or 2 wherein said projectiles are in the form of cubes.

13. The missile warhead of claim 1 or 2 wherein said projectiles are in the form of hexahedrons.

14. The missile warhead of claim 1 or 2 wherein said projectiles are in the form of rods.

15. The missile warhead of claim 1 or 2 wherein the thickness of said projectiles is varied to provide a desired charge-to-mass ratio.

16. The missile warhead of claim 1 or 2 wherein the outer periphery of said grooves are sharp to promote uniform fragment size.

17. The missile warhead of claim 1 or 2 wherein the outer periphery of said grooves are rounded to avoid stress concentration.

18. The missile warhead of claim 1 or 2 wherein said projectiles are substantially hollow to enhance penetration.

* * * * *